United States Patent [19]

Kawasaki et al.

[11] Patent Number: 4,980,337

[45] Date of Patent: Dec. 25, 1990

[54] THERMOSENSITIVE RECORDING MATERIAL

[75] Inventors: Kanjirou Kawasaki; Hiroshi Sakamoto, both of Numazu; Hiroaki Inoue, Fuji, all of Japan

[73] Assignee: Ricoh Company Ltd., Tokyo, Japan

[21] Appl. No.: 381,994

[22] Filed: Jul. 17, 1989

Related U.S. Application Data

[63] Continuation of Ser. No. 130,175, Dec. 8, 1987, abandoned.

[30] Foreign Application Priority Data

Dec. 8, 1986 [JP] Japan ..... 61-291924
Oct. 16, 1987 [JP] Japan ..... 62-261065

[51] Int. Cl.[5] ..... B41M 5/18

[52] U.S. Cl. ..... 503/226; 427/152; 503/200

[58] Field of Search ..... 427/150–152; 428/913, 914; 503/200, 226

[56] References Cited

FOREIGN PATENT DOCUMENTS 59-225987 12/1984 Japan ..... 503/200

*Primary Examiner*—Pamela R. Schwartz

*Attorney, Agent, or Firm*—Oblon, Spivak, McClelland, Maier & Neustadt

[57] ABSTRACT

A thermosensitive recording material is disclosed, which comprises (a) a heat insulating support having a foamed portion with minute voids therein, (b) an undercoat layer formed on the heat insulating support, comprising as the main component a film-forming polymeric material in an amount ranging from more than 50 wt. % to 100 wt. % of the entire weight of the undercoat layer, and (c) a thermosensitive coloring layer formed on the undercoat layer, comprising a leuco dye and a color developer for inducing color formation in the leuco dye upon application of heat thereto.

5 Claims, No Drawings

THERMOSENSITIVE RECORDING MATERIAL

This application is a continuation of application Ser. No. 130,175, filed on Dec. 8, 1987, now abandoned.

BACKGROUND OF THE INVENTION

The present invention relates to a thermosensitive recording material, and more particularly to a thermosensitive recording material, utilizing a coloring reaction between a leuco dye and a color developer capable of inducing color formation in the leuco dye upon application of heat thereto, which thermosensitive recording material has excellent coloring sensitivity and is capable of yielding images with high density and high development uniformity.

A conventional thermosensitive recording material comprises a support material, such as a sheet of paper or a film, and a thermosensitive coloring layer formed thereon, which comprises a coloring system consisting of a colorless or light-colored coloring dye such as a leuco dye and a color developer capable of inducing color formation in the coloring dye upon application of heat thereto. In addition to the above coloring system, the thermosensitive coloring layer may further comprise a binder agent, a filler, a thermal sensitivity improvement agent, a lubricant and other auxiliary agents. Examples of such a thermosensitive recording material are disclosed, for example, in Japanese Pat. Publications No. 43-4160 and No. 45-14039.

Such thermosensitive recording material has the advantages over other conventional recording materials that recording can be performed in a short time by use of a comparatively simple device without the need for complicated processes such as developing and fixing, almost no noise is generated and no environmental pollution problems occur during operation, and the cost is low. Because of these advantages, the thermosensitive recording material has wide-scale utilization, not only as the recording material for copying books and documents, but also as the recording material for use with computers, facsimile apparatus, telex, medical instruments, other apparatus for recording information, and measuring instruments.

In accordance with the recent demand for high speed recording with high recording density, not only the development of a high speed recording apparatus, but also the development of a recording material that can be used with such a high speed recording apparatus is desired. For instance, there is a demand for a thermosensitive recording material that can yield clear images high image density with application of a small amount of thermal energy and has excellent head-matching properties, that is, the properties of not sticking to a thermal head for thermal image formation and not forming any dust from the recording material in the course of thermosensitive recording by use of a thermal head which comes into contact with the surface of the thermosensitive recording material.

A method by which the above demand could be met is to increase the thermosensitivity of the recording material by addition of a thermofusible material which melts at a temperature lower than the melting points of the employed leuco dye and color developer and is capable of dissolving therein the leuco dye and color developer when melted. A variety of such thermofusible materials have been proposed, for example, nitrogen-containing compounds such as acetamide, stearamide, m-nitroaniline, and phthalic acid dinitrile in Japanese Laid-Open Pat. application No. 49-34842; acetoacetic anilide in Japanese Laid-Open Pat. application No. 52-106746; and alkylated biphenyl alkanes in Japanese Laid-Open Pat. application No. 53-39139.

However, in accordance with the recent development of a high speed thermal facsimile apparatus, it has become a common practice to energize and drive a thermal head at high speed. Under such circumstances, there is a problem that the background of a thermosensitive recording sheet is also colored in the course of high speed thermosensitive recording by use of a thermal head due to the build-up of thermal energy in the thermal head and therearound. In other words, the dynamic thermosensitivity of such conventional thermosensitive recording material is still poor. Therefore it is one of the most important subjects to be cleared to enhance the dynamic coloring thermosensitivity in the conventional thermosensitive recording materials, without decreasing the coloring initiation temperature thereof. In the conventional thermosensitive recording materials, the dynamic coloring thermosensitivity cannot be increased unless a large amount of the above-mentioned thermofusible compounds is added, although the static coloring thermosensitivity can be increased to some extent by the addition of the thermofusible compounds. However, when a large amount of the thermofusible materials is employed, the sticking and dust-adhesion problems occur in the course of thermal recording by a thermal head. Further, when the melting points of the thermofusible compounds are extremely low, the thermosensitivity can be in fact increased by the addition of such thermofusible compounds, but the preservability of the thermosensitive recording material is significantly reduced so that the fogging of the background of the recording material may occur during the storage thereof.

For the purpose of improving the dynamic coloring thermosensitivity of the recording material, there have been proposed a method of improving the smoothness of the thermosensitive coloring layer, and a method of increasing the concentration of the coloring components by decreasing the relative amounts of components which do not contribute to the coloring reaction of the thermosensitive recording material, such as fillers and binder agents.

The method of improving the smoothness of the thermosensitive coloring layer is usually carried out without difficulty by use of a super calender. However, this method has the shortcomings that the background of the thermosensitive coloring layer is colored during the calendering process and the surface of the thermosensitive coloring layer becomes so glossy that the appearance of the recording material is impaired.

To the thermosensitive coloring layer, a filler such as calcium carbonate, clay and urea-formaldehyde resin may be added to maintain the whiteness of the background of the coloring layer and to prevent the sticking and dust adhesion problems during the thermosensitive recording using a thermal head. Further a water-soluble binder agent may be added to the thermosensitive coloring layer to firmly bind the coloring components and other additives of the thermosensitive coloring layer to a support. However, when the amount of such a filler and a water-soluble binder agent is reduced, the desired properties for the thermosensitive recording material cannot be obtained.

Japanese Laid-Open Pat. application No. 59-5093 discloses a thermosensitive recording material comprising a support, a highly heating insulating foamed layer which is formed on the support by coating an expandable plastic filler and expanding the filler with application of heat thereto, and a thermosensitive coloring layer formed on the foamed layer. This structure is intended to obtain a highly thermosensitive recording material, in particular, by use of the above heat insulating foamed layer. However, the surface of the heat insulating foamed layer is so unsmooth that uniform images can be hardly obtained.

Further Japanese Laid-Open Pat. application No. 59-225987 discloses a thermosensitive recording material comprising a support, a foamed layer which is formed by coating an expandable plastic filler on the support and expanding the filler with application of heat thereto, an undercoat layer comprising a filler and a binder agent, and a thermosensitive coloring layer comprising a leuco dye and a color developer, which layers are successively overlaid on the support in this order. In this prior art reference, it is mentioned that it is preferable that the amount of the binder agent contained in the undercoat layer be about 5 to 50 wt. %. By use of this undercoat layer, the surface of the foamed layer can be made smooth to some extent, but the smoothness obtained by this undercoat layer is still insufficient for obtaining enough dynamic coloring thermosensitivity and coloring uniformity for use in practice.

SUMMARY OF THE INVENTION

It is therefore an object of the present invention to a thermosensitive recording material capable of recording images clearly with high image density and high dynamic coloring sensitivity, by application of a small amount of thermal energy thereto, without impairing other necessary properties such as preservability for use in practice.

According to the present invention, the above object is achieved by a thermosensitive recording material comprising (a) a heat insulating support having a foamed portion with numerous minute voids therein, (b) an undercoat layer formed on the heat insulating support, comprising as the main component a film-forming polymeric material in an amount ranging from more than 50 wt. % to 100 wt. % of the entire weight of the undercoat layer, and (c) a thermosensitive coloring layer formed on the undercoat layer, comprising a leuco dye and a color developer for inducing color formation in the leuco dye upon application of heat thereto.

DETAILED DESCRIPTION OF THE PREFERRED EMBODIMENTS

As mentioned above, the thermosensitive recording material according to the present invention comprises (a) a heat insulating support having a foamed portion with numerous minute voids therein, which is formed, for example, by expanding an expandable plastic filler with application of heat thereto, (b) an undercoat layer formed on the heat insulating support, comprising as the main component a film-forming polymeric material in an amount ranging from more than 50 wt. % to 100 wt. % of the entire weight of the undercoat layer, and (c) a thermosensitive coloring layer formed on the undercoat layer, comprising a leuco dye and a color developer for inducing color formation in the leuco dye upon application of heat thereto.

In the above, the support has a heat insulating function and the undercoat layer formed on the support has a function of making the surface of the support uniformly smooth. By use of the heat insulating support and the undercoat layer in combination, the thermosensitive coloring layer is made so as to most effectively absorb the thermal energy released from a thermal head for thermal recording, whereby clear images with high and uniform density can be obtained.

Further as mentioned above, the heat insulating support for use in the present invention has a foamed portion which is formed by expanding an expandable plastic filler with application of heat thereto. Such a heat insulating support can be prepared, for example, by any of the following methods: (i) a method of forming a foamed layer on a conventional support such a sheet of paper or synthetic paper and a plastic film (which is hereinafter referred to as the base support), by coating an expandable plastic filler on the base support and then expanding the plastic filler with application of heat thereto, (ii) a method of adding an expandable plastic filler to wood pulp or synthetic pulp prior to sheet making and preparing a heat insulating support from such pulp and (iii) a method of adding an expandable plastic filler to a base support such as paper or synthetic paper by size pressing at the time of sheet making.

The expandable plastic filler for use in the present invention is a hollow plastic filler consisting of a shell made of a thermoplastic resin and a solvent having a low boiling point serving as foaming agent placed inside the shell. The plastic filler is caused to expand upon application of heat. Various types of conventionally known expandable plastic fillers can be used in the present invention. For use in the present invention, it is preferable that the diameter of the filler particles be 2 to 50 $\mu$m, more preferably 5 to 20 $\mu$m, in an unexpanded state, and 10 to 100 $\mu$m, more preferably 10 to 50 $\mu$m in an expanded state.

As the thermoplastic resin for the shell of this plastic filler, polystyrene, polyvinyl chloride, polyvinylidene chloride, polyvinyl acetate, polyacrylic acid ester, polyacrylonitrile, polybutadiene and copolymers of the above can be employed.

As the foaming agent placed in the shell, propane and isobutane can be employed.

When a heat insulating support is prepared by the previously mentioned method (i), the above-mentioned expandable plastic filler is coated together with a binder agent on a base support and dried, and the coated plastic filler layer is heated to expand the plastic filler. It is preferable that the coating amount of the expandable plastic filler in an unexpanded state be at least 1 g/m$^2$, more preferably about 2 to 5 g/m$^2$, on the base support. The binder to be used in combination with the plastic filler may be employed in an effective amount for binding the foamed layer sufficiently firmly to the base support, for instance, in the range of 5 to 50 wt. % of the total amount of the plastic filler in an unexpanded state and the binder agent.

It is preferable that the foaming temperature be one at which the thermoplastic resin of the shell of the filler is softened. It is preferable that the foaming magnification ratio be 2 to 10 times the particle size of the filler.

When a heat insulating support is made by the previously mentioned method (ii) of adding an expandable plastic filler to wood pulp or synthetic pulp prior to sheet making, such wood pulps as are commercially available under the trademarks of NBKP, LBKP, NBSP and LBSP are usually employed. Synthetic fibers such vinylon and synthetic pulp made of polyethylene may also be employed by mixing with the above-mentioned wood pulps. It is preferable that the freeness of the pulp be in the range of 200 cc to 500 cc (C.S.P) for sheet making and the weave of the support. When this heat insulating support is prepared, if necessary, a filler such as clay, talc, calcium carbonate, finely-divided particles of urea resin, a sizing agent such as rosin, alkyl ketene dimer, higher fatty acid salts, paraffin wax, and alkenyl succinic acid, and a fixing agent such as aluminum sulfate and a cationic polymer may be added to the pulp.

It is preferable that the density of the support prepared by the above-mentioned methods (ii) and (iii) be in the range of 0.1 to 0.7 g/cm$^3$.

The thus prepared heat insulating support having a portion of minute voids still have a rough surface. Therefore in the present invention, an undercoat layer comprising as the main component a film-forming polymeric material is formed on the heat insulating support.

It is preferable that the coating amount of such an undercoat layer be at least 1 g/m$^2$, more preferably about 2 to 10 g/m$^2$.

As the film-forming polymeric material for the undercoat layer, a variety of binder agents including the binder agents that can be employed in the thermosensitive coloring layer which will be mentioned later can be employed. Of such binder agents, hydrophobic polymer emulsions and mixtures of water-soluble polymers and water-resisting agents are preferably employed.

Examples of hydrophobic polymer emulsions are emulsions of styrene/butadiene copolymer latex, acrylonitile/butadiene/styrene copolymer latex, vinyl acetate resin, vinyl acetate/acrylic acid copolymer, styrene/acrylic acid ester copolymer, acrylic acid ester resin, and polyurethane resin. Of such polymeric materials, emulsions of styrene/butadiene copolymer latex, polyvinylidine chloride and polyvinyl acetate are particularly preferably for use in the present invention.

Examples of water-soluble polymers are polyvinyl alcohol, starch, starch derivatives, cellulose derivatives such as methoxycellulose, hydroxyethylcellulose, carboxy-methylcellulose, methylcellulose, and ethylcellulose, and other water-soluble polymers such as sodium polyacrylate, polyvinyl pyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein.

The previously mentioned water-resisting agents are such agents that condense or cross-link with the above-mentioned water-soluble polymeric materials to make the water-soluble polymeric materials resistant to water. Examples of such water-resisting agents are formaldehyde, glyoxal, chromium alum, melamine, melamine-formaldehyde resin, polyamide resin and polyamide-epichlorohydrin resin. It is preferable that the ratio of the amount of these water-resisting agents added to the water-soluble polymeric materials be 20% to 100%.

Further in the present invention, a filler may be added to the undercoat layer in order to facilitate the coating operation of the undercoat layer. It is preferable that the amount of a filler for use in the undercoat layer be in the range of 0 to 50 wt. %, more preferably in the range of 0 to 40 wt. %. Therefore, it is preferable that the amount of the film-forming polymer to be used in combination with such a filler be in the range of more than 50 wt. % to 100 wt. %, more preferably in the range of 60 to 100 wt. %. When the amount of a filler in the undercoat layer is 50 wt. % or more, the advantage obtained by using the film-forming polymer cannot be sufficiently obtained so that the uniformity of the images is reduced.

As the filler to be used in combination with the film-forming polymer in the undercoat layer, a variety of finely-divided organic or inorganic particles can be employed, which are used in the thermosensitive coloring layer mentioned later.

As the leuco dyes for use in the present invention, any conventional leuco dyes for use in conventional thermosensitive recording materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3,-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-isoamylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino) fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethyl-anilino)fluoran, 3-pyrrolidino-7-(di-p-chlorophenyl)methylamino-fluoran,
3-diethylamino-5-chloro-7-(α-phenylethylamino)-fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-α-naphthyl-amino-4'-bromofluoran, and
3-diethylamino-6-methyl-7-mesidino-4',5'-benzofluoran.

As the color developers for use in combination with the above leuco dyes in the present invention, capable of inducing color formation in the leuco dyes, a variety of electron acceptors can be employed, such as phenolic materials, organic and inorganic acids, and esters and salts thereof.

Specific examples of such color developers are gallic acid, salicylic acid, 3-isophenyl salicylic acid, 3-cyclohexyl salicylic acid, 3,5-di-tert-butyl salicylic acid, 3,5-di-α-methylbenzyl salicylic acid, 4,4'-isopropylidenediphenol, 4,4'-isopropylidenebis-(2-chlorophenol), 4,4'-isopropylidenebis(2,6-dibromophenol), 4,4'-isopropylidenebis(2,6-dichlorophenol), 4,4'-isopropylidenebis-(2-methylphenol), 4,4'-isopropylidenebis-2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis-(2-methylphenol), 4-tert-butylphenol, 4-phenylphenol, 4-hydroxy-diphenoxide, α-naphthol, β-naphthol, 3,5-xylenol, thymol, methyl-4-hydroxybenzoate, 4-hydroxyacetophenone, novolak-type phenolic resin, 2,2'-thiobis(2,6-dichlorophenol), catechol, resorcinol, hydroquinone, pyrogallol, phloroglucine, phlorogluocinocarboxylic acid, 4-tert-octylcatechol, 2,2'-methylenebis(4-chlorophenol), 2,2'-methylenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxy-diphenylsulfone, 4-hydroxy-4'-chlorodiphenylsulfone, bis(4-hydroxyphenyl)sulfide, 2-hydroxy-p-toluic acid, zinc 3,5-di-tert-butylsalicylate, tin 3,5-di-tert-butyl-salicyate, tartaric acid, oxalic acid, maleic acid, citric acid, succinic acid, stearic acid, 4-hydroxyphthalic acid, boric acid, thiourea derivatives, and 4-hydroxythiophenol derivatives.

In the present invention, a variety of conventional binder agents can be employed for binding the above mentioned leuco dyes and color developers to the undercoat layer.

Specific examples of such binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinyl pyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutyl-methacrylate, ethylene/vinyl acetate copolymer and styrene/butadiene/acrylic acid derivative copolymer.

Further in the present invention, auxiliary additive components which are employed in the conventional thermosensitive recording materials, such as a filler, a surface active agent and a thermofusible material (or unguent), can be employed, together with the above-mentioned leuco dyes and color developers.

Specific examples of a filler for use in the present invention are finely-divided inorganic powders of calcium carbonate, silica, zinc oxide, titanium oxide, aluminum hydroxide, zinc hydroxide, barium sulfate, clay, talc, surface-treated calcium and surface-treated silica, and finely-divided organic powders of urea - formaldehyde resin, styrene/methacrylic acid copolymer, and polystyrene.

As the thermofusible material, for example, higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermofusible organic compounds having melting points ranging from about 50°C. to 200°C. can be employed.

By referring to the following examples, the present invention will now be explained in detail.

EXAMPLE 1

Preparation of Foamed Layer Bearing Sheet A-1

A mixture of the following formulation was dispersed in a dispersing apparatus, whereby an expandable layer coating liquid was prepared:

| | Parts by Weight |
|---|---|
| Expandable plastic filler (copolymer of vinylidene chloride and acrylonitrile for the material for the shell, and isobutane for the foaming agent) | 15 |
| 10% aqueous solution of polyvinyl alcohol | 15 |
| Water | 70 |

The above expandable layer coating liquid was coated on a sheet of commercially available high quality paper in a deposition amount of 2.0 to 3.0 g/m$^2$ on dry basis in an unexpanded state, and the coated liquid was dried to form an expandable layer. The surface of the coated expandable layer was then brought into close contact with the surface of a rotary type drum dryer having a built-in heater, so that the expandable layer was foamed at a surface temperature of 120°C. to 130°C. with application of heat thereto for about 2 minutes, whereby a foamed layer bearing sheet A-1 was prepared.

Preparation of Undercoat Layer Coating Liquid B-1

A mixture of the following formulation was stirred in an agitator, whereby an undercoat layer coating liquid was prepared:

| | Parts by Weight |
|---|---|
| Styrene/butadiene copolymer latex emulsion (solid components: 48%) | 62.5 |
| Water | 37.5 |

The above undercoat layer coating liquid was coated on the above-mentioned foamed layer in a deposition amount of 4.0 g/m$^2$ on dry basis, and the coated liquid was dried, whereby an undercoat layer was formed on the foamed layer.

Apart from the above, Liquid [C] and Liquid [D] were prepared by grinding and dispersing the following respective mixtures separately in a ball mill and in an attritor until the volume mean diameter of the dispersed particles became about 1.5 $\mu$m:

Composition of Liquid [C]

| | Parts by Weight |
|---|---|
| 3-(N-cyclohexyl-N-methyl)amino-6-methyl-7-anilinofluoran | 20 |
| 10% aqueous solution of polyvinyl alcohol | 16 |
| Water | 54 |

Composition of Liquid [D]

A mixture of Liquid [C] and Liquid [D] with a mixing ratio of 1:4 by weight was stirred, so that a thermosensitive coloring layer coating liquid was prepared.

This thermosensitive coloring layer coating liquid was coated on the undercoat layer in a deposition amount of 3.0 to 4.0 g/m$^2$ on dry basis, and the coated liquid was dried to form a thermosensitive coloring layer. The thus formed thermosensitive coloring layer was calendered, whereby a thermosensitive recording material No. 1 according to the present invention was prepared.

EXAMPLE 2

Example 1 was repeated except that the styrene/-butadiene copolymer latex emulsion in the formulation of the undercoat layer coating liquid B-1 in Example 1 was replaced by a polyvinyl acetate emulsion (solid components: 48%), whereby a thermosensitive recording material No. 2 according to the present invention was prepared.

EXAMPLE 3

Example 1 was repeated except the undercoat layer coating liquid B-1 employed in Example 1 was replaced by an undercoat layer coating liquid B-2 of the following formulation, whereby a thermosensitive recording material No. 3 according to the present invention was prepared:

Formulation of Undercoat Layer Coating Liquid B-2

| | Parts by Weight |
|---|---|
| 10% aqueous solution of polyvinyl alcohol | 60 |
| 10% aqueous solution of polyamide-epichlorohydrin resin | 20 |
| Water | 20 |

COMPARATIVE EXAMPLE 1

Example 1 was repeated except that the foamed layer and the undercoat layer formed on the support in Example 1 were eliminated, whereby a comparative thermosensitive recording material No. 1 was prepared.

COMPARATIVE EXAMPLE 2

Example 1 was repeated except that the undercoat layer formed on the foamed layer in Example 1 was eliminated, whereby a comparative thermosensitive recording material No. 2 was prepared.

COMPARATIVE EXAMPLE 3

Example 1 was repeated except that the foamed layer formed on the support in Example 1 was eliminated, whereby a comparative thermosensitive recording material No. 3 was prepared.

COMPARATIVE EXAMPLE 4

Example 1 was repeated except the undercoat layer coating liquid B-1 employed in Example 1 was replaced by a comparative undercoat layer coating liquid CB-1 of the following formulation, which coating liquid was coated in a deposition amount of 4 g/m$^2$ on dry basis, whereby a comparative thermosensitive recording material No. 4 was prepared:

Formulation of Comparative Undercoat Layer Coating Liquid CB-1

| | Parts by Weight |
|---|---|
| Styrene/butadiene copolymer latex emulsion (solid components: 48%) | 8 |
| Finely-divided silica particles | 20 |
| Water | 72 |

COMPARATIVE EXAMPLE 5

Example 1 was repeated except the undercoat layer coating liquid B-1 employed in Example 1 was replaced by a comparative undercoat layer coating liquid CB-2 of the following formulation, which coating liquid CB-2 was coated in a deposition amount of 4 g/m$^2$ on dry basis, whereby a comparative thermosensitive recording material No. 5 was prepared:

Formulation of Comparative Undercoat Layer Coating Liquid CB-2

| | Parts by Weight |
|---|---|
| 40% aqueous dispersion of polystyrene resin | 52.5 |
| 20% aqueous solution of starch | 17.5 |
| Styrene/butadiene latex (solid components: 48%) | 7.3 |
| Water | 22.7 |

The thermosensitive recording materials No. 1 through No. 3 according to the present invention and the comparative thermosensitive recording materials No. 1 through No. 5 were subjected to dynamic thermal coloring sensitivity tests by use of a G-III facsimile test apparatus, and the image densities of the formed images were measured by use of a Macbeth densitometer RD-514 with a filter Wratten-106 attached thereto.

More specifically the dynamic thermal coloring sensitivity tests were conducted by performing thermal printing on each of the above thermosensitive recording materials by a G-III facsimile test apparatus having an 8 dots/mm thermal head (commercially available by Matsushita Electronic Components Co., Ltd.) including a heat generating resistor of about 400Ω/dot, under the conditions that the main scanning recording speed was 20 msec/line, the sub-scanning recording speed was 3.85 /mm, the pressure application by a platen was 1.4 kg/cm$^2$, and the electric power applied to the thermal head was 0.4 W/dot, with the electric power application time changed to 0.5 msec, 1.0 msec, 1.4 msec, and 1.8 msec. The results are shown in Table 1.

The thermosensitive recording material samples with the images formed by application of the electric power for 1.0 msec were visually inspected to see the uniformity of the developed images within an area of 1 cm$^2$ in each sample, specifically by checking whether or not there are any non-uniformly developed portions in the 1 cm$^2$ area. The results are shown in Table 1.

TABLE 1

| | Dynamic Thermal Coloring Sensitivity | | | | Uniformity of Developed Images |
|---|---|---|---|---|---|
| | 0.5 ms | 1.0 ms | 1.4 ms | 1.8 ms | |
| Example 1 | 0.30 | 1.01 | 1.35 | 1.40 | O |
| Example 2 | 0.28 | 0.95 | 1.30 | 1.38 | O |
| Example 3 | 0.27 | 0.92 | 1.29 | 1.38 | O |
| Comp. Example 1 | 0.10 | 0.55 | 0.81 | 1.15 | Δ |
| Comp. Example 2 | 0.22 | 0.70 | 1.09 | 1.30 | X |
| Comp. Example 3 | 0.20 | 0.73 | 1.10 | 1.33 | O |
| Comp. Example 4 | 0.16 | 0.84 | 1.19 | 1.35 | Δ |
| Comp. Example 5 | 0.17 | 0.85 | 1.18 | 1.35 | Δ |

(Note)
O: The uniformity of the developed images was perfect.
Δ: Non-uniform portions were slightly observed.
X: Non-uniform portions were explicitly observed.

The results shown in the above Table 1 indicate that the thermosensitive recording materials according to the present invention are capable of yielding images with high image density and high development uniformity by application of a small amount of thermal energy.

What is claimed is:

1. A thermosensitive recording material comprising:
(a) a heat insulating support having a foamed portion with minute voids therein,
(b) an undercoat layer formed on said heat insulating support, comprising as the main component a film-forming polymeric material in an amount ranging from more than 60 wt. % to 100 wt. % of the entire weight of the undercoat layer, and
(c) a thermosensitive coloring layer formed on said undercoat layer, comprising a leuco dye and a color developer for inducing color formation in the leuco dye upon application of heat thereto.

2. The thermosensitive recording material as claimed in claim 1, wherein said film-forming polymeric material is a hydrophobic polymer.

3. The thermosensitive recording material as claimed in claim 2, wherein said hydrophobic polymer is a polymeric material selected from the group consisting of styrene-butadiene, polyvinylidene chloride, and polyvinyl acetate.

4. The thermosensitive recording material as claimed in claim 1, wherein said film-forming polymeric material is a combination of a water-soluble polymer and a water-resisting agent.

5. A thermosensitive recording material comprising:
(a) a heat insulating support having a foamed portion with minute voids therein;
(b) an undercoat layer formed on said heat insulating support, consisting of a film-forming polymeric material, and
(c) a thermosensitive coloring layer formed on said undercoat layer, comprising a leuco dye and a color developer for inducing color formation in the leuco dye upon application of heat thereto.

* * * * *